US007371105B1

(12) United States Patent
Allende

(10) Patent No.: US 7,371,105 B1
(45) Date of Patent: May 13, 2008

(54) ELECTRICAL PLUG LOCK

(76) Inventor: Luis Allende, Calle 242 JWC7 Country Club, Carolina, PR (US) 00982

( * ) Notice: Subject to any disclaimer, the term of this patent is extended or adjusted under 35 U.S.C. 154(b) by 0 days.

(21) Appl. No.: 11/725,506

(22) Filed: Mar. 19, 2007

(51) Int. Cl.
*H01R 13/64* (2006.01)

(52) U.S. Cl. ..... 439/373

(58) Field of Classification Search ..... 439/373, 439/147; 174/67
See application file for complete search history.

(56) References Cited

U.S. PATENT DOCUMENTS 2,761,112 A * 8/1956 Torcivia ..... 439/147
2,987,690 A * 6/1961 Marbais ..... 439/135
3,428,936 A 2/1969 Amao
3,601,757 A 8/1971 Gober
4,281,214 A * 7/1981 Miyamoto et al. ..... 174/138 F
4,457,571 A 7/1984 Lavine
4,531,800 A 7/1985 Avener
4,702,709 A 10/1987 Santilli
6,198,046 B1 * 3/2001 Moodie ..... 174/67
6,457,843 B1 * 10/2002 Kester et al. ..... 362/276
6,491,539 B1 12/2002 Johnston
6,699,060 B1 * 3/2004 Scott ..... 439/373
6,805,580 B2 * 10/2004 Piedmont ..... 439/516
7,097,474 B1 * 8/2006 Naylor ..... 439/135

* cited by examiner

*Primary Examiner*—Neil Abrams

(57) ABSTRACT

A wall socket cover that is mounted on a wall socket unit by a threaded fastener coupled to the threaded opening of the wall socket unit. The cover has two arcuate portions that encase plugs associated with the wall socket and which include openings through which the electrical cords associated with the plugs extend.

2 Claims, 1 Drawing Sheet

ELECTRICAL PLUG LOCK

TECHNICAL FIELD OF THE INVENTION

The present invention relates to the general art of electrical accessories, and to the particular field of wall outlet protectors.

BACKGROUND OF THE INVENTION

Electrical socket outlets are well known to provide access to the main power supply of a building. Such outlets are often mounted in a hole formed in a building wall. Once the electrical socket housing has been mounted in the wall, a cover plate is typically secured over the opening so that only the access apertures in the socket face are exposed on the outside of the wall. For example, the cover plate includes an aperture adapted to register with the socket face. Typically, a mounting hole registers with a threaded bore in the electrical housing so that a mounting bolt inserted therethrough mounts the plate over the housing, whereby the edges of the cover plate engage a peripheral wall portion surrounding the hole in the wall. As a result, the previously known cover plate provides a finished appearance to the electrical outlet housing, and prevents exposure of the electrical components within the housing, although a particularly configured plug adapted to be inserted within the access openings of the sockets can be engaged therein.

While the previously known electrical plug receptacles permit electrically operated devices to receive the electrical power by merely plugging in an appropriate plug into the receptacle, however, the plug can be easily removed from the receptacle as well. Thus, when the electrical cord extending between the plug and the electrically operated device is pulled upon, either from moving the device, a person tripping over the cord, the inadvertent activities of a child or a pet can cause the cord and hence the plug to be pulled upon. This pulling tension in the cord can easily displace the plug from its receptacle connection resulting in an the undesirable loss of electrical power to the device.

While there are known attachments for electrical outlet cover plates, none are well adapted to positively retain the plug within the socket as the electrical cord is pulled in the direction away from the electrical outlet.

Therefore, there is a need for a means for positively retaining an electrical plug in place in an outlet.

SUMMARY OF THE INVENTION

The above-discussed disadvantages of the prior art are overcome by a cover for a wall outlet which includes two identical halves each of which includes a planar base and a semicircular portion that is raised above the plane of the base and which covers the jack of the wall socket when the cover is fixed to the wall socket by a fastener extending through a fastener-accommodating hole defined in the base and which is threadably connected to the threaded hole on the wall socket. A slot is defined in one edge of the semicircular portion to accommodate an electrical cord. When the two halves are attached to the wall socket, a plug associated with that wall socket is encased by the semicircular openings and thus securely held to the wall socket.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
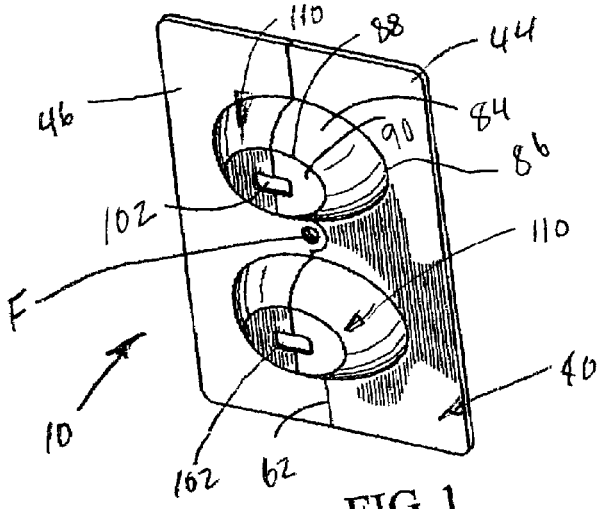
FIG. 1 is a perspective view of a wall socket cover embodying the present invention.
Figure 2:
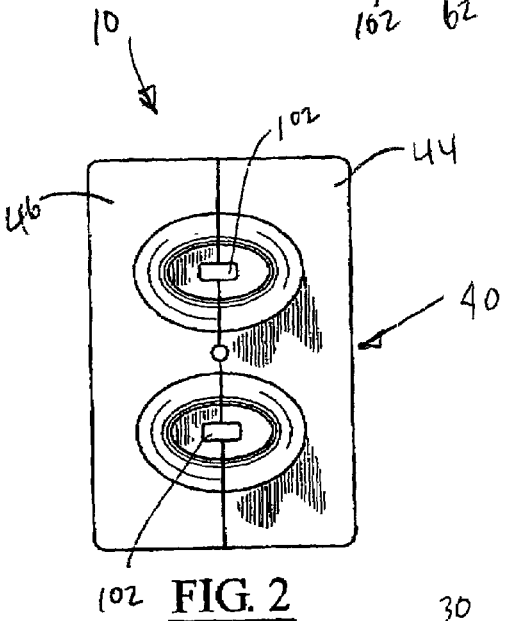
FIG. 2 is a front elevational view of the wall socket cover in the assembled condition.
Figure 3:
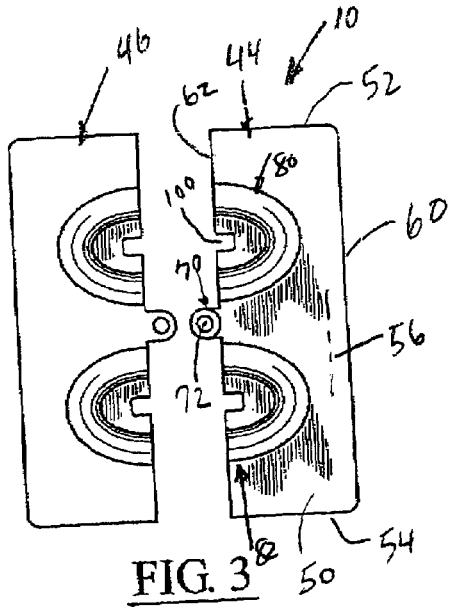
FIG. 3 is a front elevational view of the wall socket cover in the dis-assembled condition.
Figure 4:
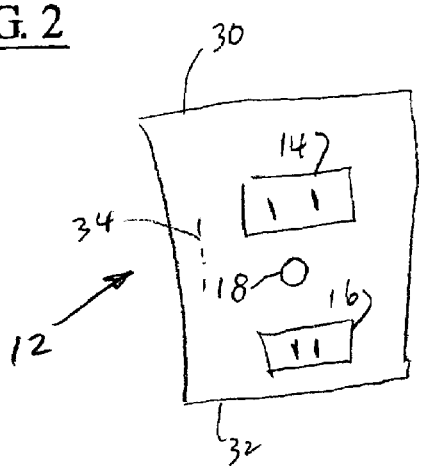
FIG. 4 (PRIOR ART)
FIG. 4 is a sketch of a wall socket unit.

Referring to the figures, it can be understood that the present invention is embodied in a wall socket cover 10 which comprises a wall socket unit 12 which includes two female outlet jacks 14 and 16 and an internally threaded fastener-accommodating bore 18 located between the two outlet jacks. The wall socket unit includes a first end 30 which is a top end when the wall socket unit is in use, a second end 32 which is a bottom end when the wall socket unit is in use and a longitudinal axis 34 which extends between first end 30 and second end 32 of the wall socket unit. The outlet jacks are located on the longitudinal axis and are spaced apart from each other in the direction of longitudinal axis 34.

An cover unit 40 includes first and second cover elements 44 and 46. The cover elements are mirror images of each other and each cover element is one-piece construction. Each of the cover elements includes a planar base plate 50 which includes a first end edge 52 which is a top end edge when the cover unit is in use, a second end edge 54 which is a bottom end edge when the cover unit is in use and a longitudinal axis 56 which extends between first end edge 52 and second end edge 54 and which extends parallel to longitudinal axis 34 of the wall socket unit when the cover unit is in use. Each base plate further includes a first side edge 60 and a second side edge 62 which is located adjacent to longitudinal axis 34 of the wall socket unit when the cover unit is in use.

A mounting bracket 70 is located on second side edge 62 and includes a fastener-accommodating hole 72 which is located to be aligned with internally threaded fastener-accommodating bore 18 of the wall socket unit when the cover unit is in use. The fastener-accommodating hole of the first cover element overlaps the fastener-accommodating hole of the second cover element to be congruent therewith when the cover unit is in place on the wall socket unit so a threaded fastener F will extend through the congruent holes to fasten the cover unit to the wall socket unit.

Each cover element further includes first and second plug encasing elements 80 and 82. Plug encasing elements 80 and 82 are identical to each other and each includes an oval shaped wall 84 which has a first end 86 that is one-piece with the base plate and a second end 88 that is spaced apart from the base plate. A planar wall 90 is one piece with second end 88 of the oval shaped wall and extends parallel to a plane containing the base plate.

A rectangular notch 100 is defined in planar wall 90. The notch of each cover element is located to be aligned with one of the female outlet jacks of the wall socket unit when the cover unit is in place on the wall socket unit. The notches of the first cover element are each aligned with an associated notch of the second cover unit to define a rectangular opening 102 through the cover unit when the cover unit is in place on the wall socket unit.

The plug encasing element on the first cover element co-operates with the plug encasing element of the second cover element to define a plug case 110 in which a plug connected to the wall socket unit is contained with a lead associated with the plug extending out of the plug case through the rectangular opening defined by the two associated notches that are located adjacent to the plug when the plug is in the wall socket unit and the cover unit is in place covering the plug.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A wall socket cover comprising:

A) a wall socket unit which includes (1) two female outlet jacks, (2) an internally threaded fastener-accommodating bore located between the two outlet jacks, (3) a first end which is a top end when the wall socket unit is in use, (4) a second end which is a bottom end when the wall socket unit is in use, (5) a longitudinal axis which extends between the first end of the wall socket unit and the second end of the wall socket unit, the outlet jacks being located on the longitudinal axis and being spaced apart from each other in the direction of the longitudinal axis; and B) an cover unit which includes (1) first and second cover elements, the cover elements being mirror images of each other, each cover element being one-piece and including (a) a planar base plate, the planar base plate including (i) a first end edge which is a top end edge when the cover unit is in use, (ii) a second end edge which is a bottom end edge when the cover unit is in use, (iii) a longitudinal axis which extends between the first end edge and the second end edge and which extends parallel to the longitudinal axis of the wall socket unit when the cover unit is in use, (iv) a first side edge, (v) a second side edge which is located adjacent to the longitudinal axis of the wall socket unit when the cover unit is in use, (b) a mounting bracket on the second side edge, the mounting bracket including a fastener-accommodating hole which is located to be aligned with the internally threaded fastener-accommodating bore of the wall socket unit when the cover unit is in use, the fastener-accommodating hole of the first cover element overlapping the fastener-accommodating hole of the second cover element to be congruent therewith when the cover unit is in place on the wall socket unit so a threaded fastener will extend through the congruent holes to fasten the cover unit to the wall socket unit, (c) first and second plug encasing elements, the plug encasing elements being identical to each other and each including (i) an oval shaped wall which has a first end that is one-piece with the base plate and a second end spaced apart from the base plate, (ii) a planar wall which is one piece with the second end of the oval shaped wall and which extends parallel to a plane containing the base plate, and (iii) a rectangular notch defined in the planar wall, the notch being located to be aligned with one of the female outlet jacks of the wall socket unit when the cover unit is in place on the wall socket unit, the notch of the first cover element being aligned with an associated notch of the second cover unit to define a rectangular opening through the cover unit when the cover unit is in place on the wall socket unit, (d) the plug encasing element on the first cover element co-operating with the plug encasing element of the second cover element to define a plug case in which a plug connected to the wall socket unit is contained with a lead associated with the plug extending out of the plug case through the rectangular opening defined by the two associated notches that are located adjacent to the plug when the plug is in the wall socket unit and the cover unit is in place covering the plug.

2. A wall socket cover comprising:

A) first and second cover elements, the cover elements being mirror images of each other, each cover element being one-piece and including (a) a planar base plate, (b) a mounting bracket on the base plate and including a fastener-accommodating hole which is located to be aligned with a fastener-accommodating bore of the wall socket unit when the cover unit is in use, the fastener-accommodating hole of the first cover element overlapping the fastener-accommodating hole of the second cover element to be congruent therewith when the cover unit is in place on the wall socket unit so a threaded fastener will extend through the congruent holes to fasten the cover unit to the wall socket unit, (c) first and second plug encasing elements, the plug encasing elements being identical to each other and each including (i) a wall which has a first end that is one-piece with the base plate and a second end spaced apart from the base plate, (ii) a planar wall which is one piece with the second end of the wall, and (iii) a rectangular notch defined in the planar wall, the notch being located to be aligned with a female outlet jack of the wall socket unit when the cover unit is in place on the wall socket unit, the notch of the first cover element being aligned with a corresponding notch of the second cover unit to define a rectangular opening through the cover unit when the cover unit is in place on the wall socket unit, (d) the plug encasing element on the first cover element co-operating with the plug encasing element of the second cover element to define a plug case in which a plug connected to the wall socket unit is contained with a lead associated with the plug extending out of the plug case through the rectangular opening defined by the two associated notches that are located adjacent to the plug when the plug is in the wall socket unit and the cover unit is in place covering the plug.

* * * * *